US006284059B1

(12) United States Patent
Zupancich

(10) Patent No.: US 6,284,059 B1
(45) Date of Patent: Sep. 4, 2001

(54) CLEANING AND CONVERSION COATING OF HOT ROLLED STEEL ARTICLES

(75) Inventor: Ronald J. Zupancich, Cortland, OH (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/370,788

(22) Filed: Aug. 5, 1999

Related U.S. Application Data

(60) Provisional application No. 60/095,574, filed on Aug. 6, 1998.

(51) Int. Cl.[7] ..... C23C 22/78

(52) U.S. Cl. ..... 148/254; 148/255; 148/256; 134/3; 134/28; 134/41

(58) Field of Search ..... 148/254, 255, 148/256; 134/3, 28, 41

(56) References Cited

U.S. PATENT DOCUMENTS 3,515,599 * 6/1970 Connelly ..... 148/254

3,961,991 * 6/1976 Yoshida et al. ..... 148/254

OTHER PUBLICATIONS

"Properties and Selection of Metals,"*Metals Handbook*, 8th Ed., vol. 1, published by *American Society for Metals*, Copyright 1961, pp. 79–87, Dec. 1961.

"Heat Treating, Cleaning and Finishing,"*Metals Handbook*, 8th Ed., vol. 2, published by *American Society for Metals*, Copyright 1964, pp. 340–346, Dec. 1964.

* cited by examiner

*Primary Examiner*—Roy King
*Assistant Examiner*—Andrew L. Oltmans
(74) *Attorney, Agent, or Firm*—Baker Botts L.L.P.

(57) ABSTRACT

A process is disclosed in which hot rolled steel articles, such as rail car articles, LP tanks and barge articles are cleaned and conversion coated. The cleaning compositions comprise aqueous phosphoric acid, and the conversion coating compositions comprise aqueous phosphate.

6 Claims, No Drawings

CLEANING AND CONVERSION COATING OF HOT ROLLED STEEL ARTICLES

RELATED APPLICATIONS

This application claims the benefit of U.S. Provisional Application Ser. No. 60/095,574, filed Aug. 6, 1998.

TECHNICAL FIELD OF THE INVENTION

This invention generally relates to the surface preparation of hot rolled steel. The invention relates more specifically to a surface preparation method for hot rolled steel rail cars and other articles.

BACKGROUND OF THE INVENTION

Hot and cold rolled steels are both used to fabricate a wide variety of goods, but each have unique properties depending on the temperature at which the steel has been worked or rolled in relation to the steel's critical temperature range, i.e., a temperature range through which the properties of the steel change dramatically. Hot rolled steel provided by steel mills is coated with a tough skin of steel oxide primarily composed of $Fe_3O_4$, known as "mill scale," whereas cold rolled steel has a smooth surface with very few blemishes. Hot rolled steel also has more rust that is tightly bound to the surface than does cold rolled steel.

As generally described in Metals Handbook, Volume 1: Properties and Selection, $8^{th}$ ed., T. Lyman, Ed. ASME 1961, p. 79, which is incorporated herein by reference: "Hot rolled sheets are suitable where normal surface oxide and minor imperfections are acceptable, and are generally used for parts where finish is of secondary importance . . . Cold rolled sheets are characterized by improved surface finish or special temper and properties." These differences are commonly taken into consideration when selecting a steel type, as well as a method for cleaning the surface prior to applying conversion coatings and paints. Conversion coating generally involves the treatment of steel to convert surface metal to a layer of insoluble inorganic crystals, thereby imparting corrosion resistance and aiding in paint adhesion. The primary conversion coatings are phosphate and chromate, the former being described below in greater detail.

There are a number of methods for cleaning iron and steel surfaces. Known methods include acid pickling, acid cleaning, alkaline descaling, salt bath descaling, brushing, and abrasive blasting or tumbling. In the automobile industry, acid cleaners have not been commercially embraced to nearly the same extent as alkaline cleaners.

Pickling and cleaning each involve surface treatment with a caustic solution. One difference between pickling and cleaning is that pickling usually involves immersion, whereas cleaning usually involves wiping or spraying. Another difference is that cleaning solutions are generally more dilute than pickling solutions. As stated in Metals Handbook, Volume 2: Heat Treating, Cleaning and Finishing, $8^{th}$ ed., T. Lyman, Ed. ASME 1964, p. 340, which is incorporated herein by reference: "The distinction between acid cleaning and acid pickling is a matter of degree, and there is often some overlapping in the usage of these terms. In general, however, acid pickling refers to more severe treatment for the removal of scale from semi-finished mill products, forgings or castings, whereas acid cleaning is the term most frequently used when the acid solution is employed for final or near-final preparation of metal surfaces prior to plating, painting or storage." Cleaning solutions may have acid concentrations as dilute as pH 5.5, or as concentrated as acid pickling solutions, e.g., 35 vol. percent acid or more. For example, a cleaning solution having 70 vol. percent phosphoric acid is reported in Metals Handbook, Volume 2, at p. 341.

The most common acids involved in pickling are sulfuric and hydrochloric acid, while commonly used acid cleaning agents include organic acids and weaker solutions of sulfuric and hydrochloric acid, and a variety of other mineral acids, including phosphoric acid. Dilute phosphoric acid cleaners are known to leave a light iron phosphate coating, which provides temporary resistance to corrosion and a suitable base for painting.

Acid cleaning is often carried out at room temperature, although heating is known to greatly increase efficiency. When heating is employed, the temperature of the acid is generally maintained in a range of about 140–200° F.

Cold rolled steel has long been the preferred material of construction in the automobile industry because its good surface quality enables the achievement of high quality paint finishes. Moreover, automobile parts and smaller articles have been considered amenable to chemical cleaning and conversion coatings because of their relatively small size and because those skilled in the art have found that cold rolled steel does not have so much rust and mill scale as to prevent effective use of such chemical methods.

The steel frames of ships, rail cars, earth movers, bank vaults, and power transformers are unlike those of automobiles because, in addition to being much larger, such articles are primarily hot rolled, rather than cold rolled steel. The combination of larger size and degree of mill scale and rust on steel frames of ships and rail cars has led to a view that such articles are nonanalogous to cold rolled automobile frames and smaller articles with respect to pre-painting preparation techniques, which has limited the acceptance of chemical pickling and cleaning methods in the rail car industry.

Other methods for surface cleaning and preparation include power tool cleaning, water washing, and abrasive injection in water. Power tool cleaning can remove a very high degree of rust and mill scale, but like blast cleaning, power tool cleaning generates large quantities of dust, while consuming large amounts of energy and requiring frequent maintenance and replacement of worn parts. Water washing equipment requires specialized components for operating at medium to high pressure (3000 psig or higher). For example, a pressure pump, a specialized lance and a nozzle assembly are required, in addition to large volumes of water. This technique can remove loose rust but will not effectively remove tight rust or mill scale. Abrasive injection in water may provide a greater ability to remove rust and mill scale. However, abrasive injection in water raises most of the concerns of ordinary blast cleaning, in addition to consuming large volumes of water.

Due to the drawbacks of these alternative methods, mill scale and rust on large articles made of hot rolled steel has conventionally been removed by blast cleaning, a method of removing mill scale, rust, rust scale, paint or foreign matter by the use of abrasives propelled through nozzles or by centrifugal wheels. Typically, a "Commercial Blast Cleaned Surface Finish" is sought, which is defined by the Steel Structures Painting Council (SSPC) as one from which all oil, grease, dirt, rust scale and foreign matter have been completely removed from the surface, and all rust, mill scale and old paint have been completely removed except for slight shadows, streaks, or discolorations caused by rust stain, mill scale oxides or slight, tight residues of paint or coating that may remain. If the surface is pitted, slight residues of rust or paint may be found in the bottom of pits. Under this definition, at least two-thirds of each square inch of surface area is free of all visible residues and the remainder is limited to the above-mentioned light discoloration, slight staining or tight residues.

Three major categories of abrasives that are used for blast cleaning include "grit," "shot," and "sand." "Grit" primarily comprises angular metallic particles, usually from cast steel that is crushed and hardened, and may be tempered or chilled white cast iron. Grit has extraordinary cutting power. "Shot" is also metallic, but comprises spherical particles or cut wire that deforms into rounded particles during use. "Sand" includes ordinary silica sand as well as a number of other nonmetallic abrasives, including natural minerals, such as garnet, dolomite, pumice, novaculite, and flint quartz, and synthetic materials, such as silicon carbide and aluminum oxide. These abrasives are suited to applications in which contamination with metals is undesirable.

In the United States, the field of rail car surface preparation is led by Trinity Industries, Thrall and National Rail Car. Each of these companies have employed grit blast cleaning for many years, due in large part to the longstanding understanding in the art that grit blast cleaning is the most upwardly scalable surface preparation method for articles having a high degree of mill scale and rust. Grit blast cleaning can obtain virtually any degree of cleaning of any size article—from Brush-off Blast Cleaning of a gas grill LP tank in accordance with standard SP7 of the SSPC (SSPC-SP7), to a White Metal Blast Cleaning of a rail car in accordance with standard SP5 of the SSPC (SSPC-SP5). Standard SSPC-SP7 for Brush-off Blast Cleaning provides:

> Removal of loose mill scale, loose rust, and loose paint, to the degree hereafter specified, by the impact of abrasives propelled through nozzles or by centrifugal wheels. It is not intended that the surface shall be free of all mill scale, rust, and paint. The remaining mill scale, rust, and paint should be tight and the surface should be sufficiently abraded to provide good adhesion and bonding of paint. . . .

Standard SSPC-SP7 for White Metal Blast Cleaning provides:

> Removal of all mill scale, rust, rust scale, paint or foreign matter by the use of abrasives propelled through nozzles or by centrifugal wheels. A White Metal Blast Cleaned Surface Finish is defined as a surface with a gray-white, uniform metallic color, slightly roughened to form a suitable anchor pattern for coatings. . . .

In addition to cleaning, steel pretreatments may also include chemical conversion coatings for imparting corrosion resistance and improving paint adhesion. Although manufacturers do not apply chemical conversion coatings to rail cars, phosphate conversion coatings are applied to properly cleaned steel surfaces in other industries. The three principle phosphate conversion coatings are iron phosphate, zinc phosphate, and manganese phosphate.

Iron phosphate conversion coatings, which are the oldest commercial phosphate coatings, are primarily used as a base for paint because they provide excellent adherence and resistance to flaking. However, the automobile industry has come to rely mainly on zinc phosphate for chemical conversion. Zinc phosphate is considered by the automobile industry to offer improved corrosion resistance and greater paint adhesion.

Phosphate conversion coatings may be applied by immersion, by wiping, or by spray application of the phosphate solutions. Immersion methods may be used for applying conversion coatings to small articles, whereas spray coating may be used for applying phosphate compositions to larger articles, such as transformer housings, which can be as high as twenty feet. Spray application of iron phosphate provides a layer of fine crystals having a bluish tint on steel surfaces that are substantially rust free. The layer usually has a thickness from 20 to 150 mg/ft$^2$. Phosphate coatings may be dried by various types of ovens, at temperatures up to 400° F.

All phosphate conversion coating compositions are acidic. Zinc phosphate can be sprayed at a pH as high as 3, whereas zinc phosphate immersion solutions are typically maintained within the pH range of 1.8–2.4. Iron phosphate immersion solutions are commonly maintained within a pH range of 3–6.

The inventor is not aware of any reported use of spray cleaning and conversion coating for preparing surfaces of large hot rolled steel articles, such as rail cars.

SUMMARY OF THE INVENTION

While the rail car industry has found grit blast cleaning to be a flexible method of removing up to about 95 percent of the mill scale, it is nevertheless a high cost and maintenance-intensive surface preparation method, which incurs even greater costs when attempts are made to remove more than about 95 percent of the mill scale, due to diminishing returns in labor investment in attempting to clean areas of limited accessibility. Not only does the abrasive itself have a limited life and high replacement cost, but grit blast cleaning also presents major safety concerns due to eye injuries and poses many serious operational problems. Such problems include rapid wear of mechanical moving parts due to fouling and contamination of lubricants, as well as part breakage due to abrasion and jamming. For example, there have been instances of shutdowns due to augers snapping upon being jammed with abrasive. Also, particle elevators have become jammed. Moreover, the presence of moisture is a problem with grit blast cleaning methods because the moisture causes the abrasive to agglomerate and form solid cakes, which are difficult to dislodge from the equipment, and can jam moving parts while compounding the problem of abrasive loss. Once the grit becomes caked, it then needs to be removed and replaced with new grit. There can be approximately forty to fifty-five 55-gallon drums to replace by hand, requiring about eight hours and three workers, and a loss of an entire production shift, in addition to the cost of the grit. Finally, the quality of finish attainable by grit blast cleaning is limited as a practical matter. In most commercial applications in which much of the mill scale is removed from metal surfaces, a significant amount of rust remains on hard-to-reach areas. Moreover, areas that are easily accessible are left with a 2–2.5 mil surface profile, which is an uneven surface requiring almost twice the amount of paint to coat. Consequently, there is difficulty in economically approaching a "Class A" level of "automobile quality finish" by grit blast cleaning hot rolled steel.

The above-described shortcomings are addressed by the present invention, which in one embodiment is a process for treating rail car articles comprising hot rolled steel, in which the process comprises, in order: acid spray cleaning with a solution comprising phosphoric acid, post-cleaning rinse, phosphate spraying with a solution comprising a phosphate, and post-phosphating rinse, in which mist, spray and fumes of each stage are substantially contained from carrying over to each of the other stages.

In another embodiment, the invention includes a process for treating rail car articles comprising hot rolled steel, in which the process comprises, in order: acid spray cleaning for 4–8 minutes with a solution comprising phosphoric acid, post-cleaning spray rinse, phosphate spraying for 2–4 minutes with a solution comprising a phosphate, post-phosphating spray rinse, and drying and/or curing at 200–400° F., in which mist, spray and fumes of each stage are substantially contained from carrying over to each of the other stages.

In another embodiment, the invention includes a process for treating rail car articles comprising hot rolled steel, in which the process comprises, in order: acid spray cleaning for 4–8 minutes with a solution comprising phosphoric acid, post-cleaning spray rinse, phosphate spraying for 2–4 minutes with a solution comprising a phosphate, and post-phosphating spray rinse, in which mist, spray and fumes of each stage are substantially contained from carrying over to each of the other stages by air barriers through which the articles are conveyed.

In a preferred embodiment, the articles are conveyed along rail tracks and the spray is applied to the articles as the articles move along the tracks. During this movement, the mist, spray and fumes of each stage are substantially contained from carrying over to each of the other stages by air barriers located along the tracks, through which the articles are conveyed.

In another embodiment, the invention includes a process for treating articles comprising hot rolled steel, in which the process comprises, in order: acid spray cleaning for 1–8 minutes with a solution comprising phosphoric acid, post-cleaning rinse, phosphate spraying with a solution comprising a phosphate, and post-phosphating rinse.

In another embodiment, the invention includes a process for treating LP tank articles comprising hot rolled steel, wherein the process comprises, in order: acid spray cleaning for 4–8 minutes with a solution comprising phosphoric acid, post-cleaning spray rinse, phosphate spraying for 2–4 minutes with a solution comprising a phosphate, post-phosphating spray rinse, and drying and/or curing at 300–600° F., in which mist, spray and fumes of each stage are substantially contained from carrying over to each of the other stages by air barriers through which the articles are conveyed.

DETAILED DESCRIPTION OF THE INVENTION

The invention is directed to chemical cleaning and conversion coating of hot rolled steel articles. As used in the specification and claims, a "rail car article" is defined as an article comprising at least one rail car part, an "LP tank article" is defined as an article comprising at least one Liquid Petroleum tank part, and a "barge article" is defined as an article comprising at least one barge part.

The process of the present invention is not limited to specific commercially available acid cleaning and phosphate conversion chemicals. However, as a non-limiting example of an acid cleaning composition useful for the present invention, a composition comprising 15–35 percent phosphoric acid and about 0–2 percent sulfuric acid in water may be used. Preferably, the composition contains 0.20–1.0 wt./vol. percent iron, and most preferably 0.30–0.35 wt./vol. percent iron. In formulating this composition, it was found convenient to use Parco® Cleaner 210, obtained from Henkel Technologies division of Henkel, 32100 Stephenson Highway, Madison Heights, Mich. 48071. The composition of Parco® Cleaner 210 is 50–60 percent phosphoric acid (Chemical Abstracts No 07664-38-2), about 1 percent sulfuric acid (Chemical Abstracts No 07664-93-9) and the balance water. The composition may also contain other components, such as accelerators, sodium phosphate, sodium nitrate. Steel and steel wool were found to be convenient sources of iron as an additive to the acid composition.

To obtain one rail car cleaning composition that was successful in the present invention, Parco® Cleaner 210 was mixed with a volume of water that depended on the cleaning temperature. In a laboratory test having a cleaning temperature of 160–170° F., a solution of 20–25 vol. percent Parco® Cleaner 210 in water, i.e., 10–15 vol. percent phosphoric acid and 0.2–0.25 vol. percent sulfuric acid, provided exemplary results. In a commercial test having a temperature of about 140° F., steel wool was included in a solution of 30–40 vol. percent Parco® Cleaner 210 in water, i.e., 18–25 vol. percent phosphoric acid and 0.3–0.5 vol. percent sulfuric acid, which also provided good results. Through experimentation, it has also been discovered that a combination of about 0.3 wt./vol. percent Fe, 34.5 vol. percent phosphoric, and 0.5 vol. percent sulfuric acid in water, having a pH of about 1.3, provides particularly good results.

Iron exchangers, which are commonly used in iron phosphating systems, were also found to be useful. Such exchangers may be used whenever a certain amount of iron is needed in a solution. Excess iron is removed by the iron exchanger. The iron exchanger is usually sized for the particular type of part being treated.

As used herein, the term "phosphoric acid" includes orthophosphoric acid or any condensed phosphoric acid, such as pyrophosphoric acid or tripolyphosphoric acid, so long as the ratio of $H_2O/P_2O_5$ is larger than 0 and not more than 3. "Total acidity" is defined as the total of all forms of acidity in a solution, including mineral acidity, carbon dioxide, and acid salts. Total acidity ("T.A.") may be measured in "points," which are defined for the purposes of this description to be equal to the volume of a 0.1 N sodium hydroxide solution, in milliliters, that would be required to titrate a 10 ml sample to pH 8.2 (as indicated, e.g., by a phenolphthalein indicator).

As a non-limiting example of a conversion coating useful in the present process, a composition comprising 3–5 percent iron phosphate and 0.4–0.8 percent phosphoric acid in water was found to be advantageous. This composition is conveniently formulated by mixing an appropriate amount of water with Bonderite® 1030, which was also provided by Henkel Surface Technologies. Bonderite® 1030 contains 3–5 percent iron phosphate, 1–10 vol. percent phosphoric acid (Chem Abstracts No. 07664-38-2), 1–10 vol. percent sodium nitrate (Chem Abstracts No. 07631-99-4), 10–30 vol. percent sodium chlorate (Chem Abstracts No. 0775-09-9), and other components. Accordingly, the composition of the present invention was obtained in one example by preparing a 4 vol. percent solution of Bonderite® 1030 in water, which provided good results.

According to the invention, the cleaning and phosphating stages are each respectively followed by at least one rinse stage. Thus, according to the present invention, the acid cleaning and conversion coating compositions are applied by a process comprising, in order: acid spray cleaning with a solution comprising phosphoric acid, post-cleaning spray rinse, phosphate spraying with a solution comprising a phosphate, and post-phosphating spray rinse. This does not preclude the inclusion of additional intermediate stages such as, for example, additional rinse stages. In addition, one skilled in the art can appreciate that further benefits may be obtained by including additional stages for ancillary treatments such as sealing. In some cases, according to the invention, commercial chrome free rust inhibiting sealants were employed to seal the conversion coatings on the metallic surfaces.

In order to achieve high quality cleaning and coating, while preventing cross-contamination of liquid to neighboring stages in which liquid is also applied, the inventor has found it beneficial to substantially contain the mist, spray and fumes of each stage from carrying over to each of the other stages. Thus, the invention preferably comprises the use of air barriers through which the articles are conveyed. Such air barriers may comprise silhouettes, air knives, spray comprising water, or a combination of any of these with each other or with other air barrier(s). For example, in a preferred embodiment, it is envisioned that liquid may be allowed to drain from the articles after an application of spray and before the application of liquid in a subsequent stage. As a non-limiting example, a period of time may be provided during which spraying is terminated and liquid is permitted to drain from the articles. This drain time may be provided without interrupting a conveyor, by situating the next stage and/or air barriers such as silhouettes a sufficient distance from the last spray riser or nozzle, for example 1–15 ft. to allow liquid to drain during a time that no further substantial amounts of liquid are applied. The highest spray pressures were found to call for the greatest measures to prevent mist, spray and fumes of each stage from carrying over to each of the other stages. For example, above 1,000 psig, it was found beneficial to use silhouettes that were almost flush against the articles. The edges of these silhouettes comprised rubber to prevent damage to the articles being treated. In a preferred mode of treating rail car articles, the articles may be conveyed along rail tracks, with the spray being applied to the articles as they move along the tracks and through the air barriers.

Although some recent efforts of others have focused on cleaning compositions and methods that require spraying at pressures up to 2200–2300 psig, the process according to the invention does not require such high pressures, and superior cleaning is obtained so long as there is sufficient dwell time. A dwell time of 4–8 minutes at any pressure from about 18 to about 30 psig as measured upstream of the spray nozzle (defined herein as "the acid spray pressure") has been found to provide superior results. A dwell time of 1–8 minutes at any acid spray pressure from about 5 psig up to about 70 psig is advantageous, while adequate results may be obtained at any moderate pressure. Moreover, it has been found that under such conditions, superior treatment and coatings are obtained at a moderate pH. For example, the cleaning stage of the operation may be carried out at a pH of 1.2–1.8, although a pH of about 1.5 is preferred.

A phosphate spraying dwell time of 2–4 minutes at any pressure from about 5 to about 60 psig as measured upstream of the spray nozzle (defined herein as "the phosphate spraying pressure") has been found to provide superior results. A dwell time of 1–5 minutes at any phosphate spraying pressure from about 5 psig up to about 70 psig is advantageous, while adequate results may be obtained at any moderate pressure.

The iron phosphate composition should be applied in an amount to provide a coating thickness of at least 50 mg/ft$^2$, and preferably in the range of 75 to 500 mg/ft$^2$. The most preferred coating thickness is the range of 75–150 mg/ft$^2$. Coating thickness may be measured by weighing a small sample article, usually no larger than 1 square inch in area, prior to and after coating. The coating thickness is calculated by dividing the difference in weight by the area of the article coated.

Efficiency and quality is enhanced by operating the cleaning stage and conversion treatment stage at elevated temperatures. It has been found that maintaining a temperature of 120–200 °F. upstream of the acid spray nozzle (defined herein as the "acid spray temperature") is advantageous for the cleaning stage, and a temperature of 140–170° F. is preferable, while maintaining a temperature of 80–150° F. upstream of the phosphate spray nozzle (defined herein as the "phosphate spraying temperature") is advantageous for the application of the phosphate coating, and a temperature of 120–130° F. is preferable.

For chemical cleaning and phosphating stages, it has been found advantageous to use 10–15 risers having spray nozzles 10–15 inches apart, and nozzles approximately 6–20 inches from the part. For rinse stages, the same configuration using 5–10 risers has been found advantageous. It is estimated that a flow volume of about 1,000–3,000 gal/minute is advantageous during the cleaning and phosphating stages, while 5–800 gal/minute is advantageous during the rinse stages.

In a preferred embodiment, the articles are dried and/or cured for 3–30 minutes at 200–600° F., depending on the article being processed. For rail car and barge articles, drying and/or curing takes place preferably from 200–400° F. For LP tank articles, drying and/or curing takes place preferably from 300–600° F. Gas fired convection ovens have been found to be suitable for such purposes.

After the articles are conversion coated, they may be painted. The inventor achieved excellent results upon coating test panels with two-component systems comprising water- or solvent-based epoxy or urethane. The term "two-component" refers to the mixing together of two separate components just before use to initiate a crosslinking reaction. Such coatings are also designated by the term "two-pack" or the prefix "2K" ("K" is from the German word, Komponent). Epoxies and polyurethanes are the most common 2K coatings, with polyisocyanates serving as a crosslinking agent for polyurethanes. Urethanes exhibit excellent resistance to attack by solvents, lubricants, oils and other chemicals. Good results were also achieved using powder coatings such as polyester triglycidyl isocyanurate (TGIC) powder.

Although impressive results were achieved without employing the known surface preparation methods described in the background of this application, the novel method described herein may be advantageously combined with such known methods, including mechanical cleaning methods. For example, significant advantage may be gained by combining the described method with blast cleaning, power tool cleaning, water washing, and abrasive injection in water.

EXAMPLES

Two groups of hot rolled steel articles were tested. The first was a group of Liquid Petroleum (LP) tanks each having a surface area of about 30 ft$^2$. The second was a group of panels and parts fabricated to simulate the configuration of rail cars.

Excellent results were achieved in a simulated commercial trail comprising seven stages. In each stage, the treatments were applied by spray or mist at a pressure less than 20 psig.

In the first stage, steel test articles were cleaned at 135–145° F. with a solution that throughout several trials varied in concentration in the range of 25–35 vol. percent Parco® Cleaner 210 in water. The acid spray pressure was maintained at about 10–15 psig. The articles were cleaned for a period ranging from 150 seconds to 6 minutes. The longer cleaning periods were observed to provide improved results. Throughout the trials, an increase in the iron content was also observed to improve the efficiency of the weld scale and mill scale removal. The iron content was increased further by immersing a steel test piece in the cleaning solution for a time ranging from 30 minutes to overnight, and/or adding steel wool directly to the cleaning solution. The trials began with an iron content of about 0.18–0.20 wt./vol. percent, and concluded with an iron content of about 0.30–0.35 wt./vol. percent.

A surprising amount of heavy black smut was observed in liquid trickling down areas of the test articles exposed only to the acid cleaning solution mist. It was surmised that the dwell time was more important than the physical force with which the liquid jet stream was applied to the surface. It was found that a line speed of less than 2 ft/minute, which ensured a dwell time of at least 4 minutes cleaning, provided excellent results.

The end of the cleaning stage included a period of time for draining. This period ranged from 100 seconds to several minutes. Longer drain times had the advantage of helping to limit the acidity of Stage 2.

The cleaning stage was followed by a water rinse stage comprising two steps (step 2A and step 2B), in which the pressures measured upstream of the nozzle were maintained at pressures ranging from 5 to 15 psig, and the temperatures ranged from 70 to 85° F. The end of the second water rinse step included a period of time for draining. About 100 seconds appeared to be a sufficient draining period. The pH of the rinse stage was determined to range from 3.6 to 6.5, with the first step exhibiting a lower pH than the second. A drain pan between Stage 1 and Stage 2 advantageously helped to reduce the pH decline in Stage 2.

In the fourth stage, an iron phosphate conversion coating comprising 4.0 vol. percent Bonderite® 1030 in water, at 9–10 points ("pts.") total acidity, was applied at a pressure of about 5 psig and a temperature of 90–100° F. The end of the conversion coating stage included a period of about 100 seconds for draining.

The conversion coating stage was followed by two separate rinse stages. In the first rinse stage, it was found advantageous to add an acid neutralizer to elevate the pH to above 7.5, thereby reducing flash rusting. For this purpose, a solution was selected comprising about 15–20 vol. percent sodium hydroxide in water, such as Neutralizer 700, available from Henkel Surface Technologies. The temperature in this stage was within the range of 70–90° F.

Finally, in the seventh and last stage, a solution of 0.5–1.5 vol. percent (11.5 pts.) Parcolene® 95 AT chrome-free chemical seal was applied to prevent flash rusting. Such chemical sealants may include a broad range of powder or liquid organic or inorganic sealants Inorganic sealants are preferred for power coatings, whereas either type of sealant may be used for liquid coatings.

In the cleaning and coating stages of the initial trial runs, problems of out-gassing of the coating were encountered because some areas of the test articles had not been cleaned while other areas had been heavily coated with phosphate. The problems were corrected by installing spinner carriers to rotate the tanks in Stage 1, and by installing additional risers with nozzles to improve spray patterns.

The spinner carriers cause the tanks to turn approximately 10–12 times in the stage. Moreover, there had originally been 8 risers (risers) on 12 inch centers in Stage 1. Three risers were added to each side of the stage with v-jet nozzles situated on the risers on 6 inch centers.

What is claimed is:

1. A process for treating a rail car article comprising hot rolled steel, the process comprising the following steps:

acid spray cleaning the rail car article with a solution comprising phosphoric acid, applying a post-cleaning rinse to the rail car article, phosphate spraying the article with a solution comprising a phosphate, applying a post-phosphating rinse to the rail car article, and at least partially rotating the rail car article during at least some of the process.

2. A process for treating a rail car article comprising hot rolled steel, the process comprising the following steps:

acid spray cleaning the rail car article for 4–8 minutes with a solution comprising phosphoric acid, applying a post-cleaning rinse to the rail car article, phosphate spraying the rail car article for 1–6 minutes with a solution comprising a phosphate, applying a post-phosphating rinse to the rail car article, and at least partially rotating the rail car article during at least some of the process.

3. A process for treating an article comprising hot rolled steel, wherein the process comprises the following steps:

acid spray cleaning the article for 1–8 minutes with a solution comprising phosphoric acid, applying a post-cleaning rinse to the article, phosphate spraying the article with a solution comprising a phosphate, applying a post-phosphating rinse to the article, and at least partially rotating the article during at least some of the process.

4. A process for treating an LP tank article comprising hot rolled steel, wherein the process comprises the following steps:

acid spray cleaning the LP tank article for 4–8 minutes with a solution comprising phosphoric acid, applying a post-cleaning spray rinse to the LP tank article, phosphate spraying the LP tank article for 2–4 minutes with a solution comprising a phosphate, applying a post-phosphating spray rinse to the LP tank article, drying and/or curing the LP tank article at 300–600° F., and at least partially rotating the LP tank article during at least some of the process.

5. A process for treating a rail car article comprising hot rolled steel, wherein the process comprises the following steps:

acid spray cleaning the rail car article with a solution comprising phosphoric acid and sulfuric acid, applying a post-cleaning rinse to the rail car article, phosphate spraying the rail car article with a solution comprising a phosphate, and applying a post-phosphating rinse to the rail car article.

6. A process for treating a rail car article comprising hot rolled steel, wherein the process comprises the following steps:

acid spray cleaning the rail car article for 4–8 minutes with a solution comprising phosphoric acid, applying a post-cleaning spray rinse to the rail car article, phosphate spraying the rail car article for 2–4 minutes with a solution comprising a phosphate, and applying a post-phosphating spray rinse to the rail car article; and wherein the rail car article is conveyed along rail tracks and the spray is applied to the rail car article as the rail car article moves along the tracks, and wherein mist, spray and fumes of each step are substantially contained from carrying over to other steps by air barriers located along the tracks, through which the rail car articles are conveyed.

* * * * *